US010564589B2

(12) United States Patent
Hosoi et al.

(10) Patent No.: US 10,564,589 B2
(45) Date of Patent: Feb. 18, 2020

(54) IMAGE FORMING APPARATUS INCLUDING OPTICAL PRINT HEAD

(71) Applicant: CANON KABUSHIKI KAISHA, Tokyo (JP)

(72) Inventors: Shinichiro Hosoi, Tokyo (JP); Hitoshi Iwai, Abiko (JP); Toshiki Momoka, Tokyo (JP); Takehiro Ishidate, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/398,985

(22) Filed: Apr. 30, 2019

(65) Prior Publication Data

US 2019/0346805 A1 Nov. 14, 2019

(30) Foreign Application Priority Data

May 11, 2018 (JP) ..... 2018-091892

(51) Int. Cl.

| | |
|---|---|
| ***G03G 15/00*** | (2006.01) |
| ***G03G 15/043*** | (2006.01) |
| ***G03G 21/16*** | (2006.01) |
| ***G03G 21/18*** | (2006.01) |

(52) U.S. Cl.

CPC ..... *G03G 15/80* (2013.01); *G03G 15/043* (2013.01); *G03G 21/1642* (2013.01); *G03G 21/1652* (2013.01); *G03G 21/1666* (2013.01); *G03G 21/1867* (2013.01); *G03G 21/1871* (2013.01); *G03G 2221/166* (2013.01); *G03G 2221/1636* (2013.01)

(58) Field of Classification Search

CPC .. G03G 15/80; G03G 15/043; G03G 21/1642; G03G 21/1652; G03G 21/1666; G03G 21/1867; G03G 21/1871; G03G 2221/1636; G03G 2221/166

See application file for complete search history.

(56) References Cited

U.S. PATENT DOCUMENTS

| | | | | |
|---|---|---|---|---|
| 9,304,477 | B2 | 4/2016 | Sone | |
| 2011/0157295 | A1* | 6/2011 | Sakamoto | B41J 2/45 347/224 |
| 2011/0205327 | A1* | 8/2011 | Inoue | B41J 2/451 347/247 |
| 2017/0299974 | A1* | 10/2017 | Kawano | G03G 15/043 |
| 2019/0041792 | A1* | 2/2019 | Kishi | G03G 21/1623 |

FOREIGN PATENT DOCUMENTS

JP 2015-205497 A 11/2015

* cited by examiner

*Primary Examiner* — Joseph S Wong
(74) *Attorney, Agent, or Firm* — Venable LLP

(57) ABSTRACT

An image forming apparatus includes a rotatable photosensitive drum, an optical print head that exposes the photosensitive drum and is insertable and removable through a front side of the apparatus body by an operator, a front plate that forms a part of a housing of the apparatus body and that includes an opening through which the optical print head passes when inserted and removed, a cable having one end connected to the optical print head and running along the optical print head toward the front side of the apparatus body when the optical print head is mounted to the apparatus body, and a connector which is arranged so as to have at least a part located on an outer side of the opening and to which another end of the cable is connected to be detachably attachable in order to transmit a drive signal to the optical print head.

10 Claims, 10 Drawing Sheets

IMAGE FORMING APPARATUS INCLUDING OPTICAL PRINT HEAD

BACKGROUND OF THE INVENTION

Field of the Invention

The present invention relates to an image forming apparatus including an optical print head.

Description of the Related Art

Some image forming apparatuses such as printers and copying machines have an optical print head including a plurality of light emitting elements for exposing a photosensitive drum. Some of the optical print heads use a light emitting diode (LED), an organic electro luminescence (EL) device, or the like as an example of the light emitting element. An optical print head in which a plurality of such light emitting elements is arrayed, for example, in one row or two zigzag rows along a rotational axis direction of the photosensitive drum has been known. In addition, the optical print head includes a plurality of lenses configured to collect light emitted from the plurality of light emitting elements on the photosensitive drum. The plurality of lenses is arranged to face the surface of the photosensitive drum so as to be along the arrangement direction of the light emitting elements between the plurality of light emitting elements and the photosensitive drum. The optical print head takes up a smaller space than a laser scanner unit (LSU) using a polygon mirror and has no driving portion, and thus, is advantageous for size reduction and noise reduction of the apparatus.

Meanwhile, the plurality of light emitting elements provided in the optical print head emits light in response to a drive signal from a controller provided in the image forming apparatus. The drive signal from the controller is transmitted to the optical print head via a cable. Japanese Patent Laid-Open No. 2015-205497 describes a technique of using a flexible flat cable (FFC) in order to supply electric power from a controller of an image forming apparatus to an exposure device (an LED substrate). The flexible flat cable extending from the controller is connected to a substrate connector provided on a substrate having the plurality of light emitting elements.

In addition, Japanese Patent Laid-Open No. 2015-205497 describes a method of attaching an optical print head to an image forming apparatus and a method of detaching the optical print head from the image forming apparatus. According to the description of Japanese Patent Laid-Open No. 2015-205497, a projection is formed on an end portion of the optical print head. When an operator inserts the optical print head from a front side of an image forming apparatus body into the inside of the apparatus body, the projection is fitted into a hole formed on a rear side of the image forming apparatus.

According to Japanese Patent Laid-Open No. 2015-205497, a part of the cable is fastened to a support plate (a regulating portion). As a result, a part of the cable is regulated from moving in a direction in which the optical print head is pulled out. In addition, a curved area of the cable is provided between the regulating portion and a part connected to a substrate connector. When replacing the optical print head, the operator pulls the optical print head positioned at a mounting position toward the front side (up to a pull-out position) by the amount corresponding to the curved amount of the curved area of the cable through an opening formed in a front plate. Then, the operator detaches the cable from the substrate connector on the back side of the front plate. Thereafter, the operator pulls out the optical print head toward the front side to be replaced with a new optical print head, thereby performing maintenance.

In Japanese Patent Laid-Open No. 2015-205497, however, it is difficult to make the substrate connector located on the front side of the opening when the optical print head is moved from the mounting position to the pull-out position in a state where the cable is connected to the substrate connector. Thus, it is necessary for the operator to remove the cable from the substrate connector on the back side of the opening in order to detach the optical print head from the apparatus body so that the work of detaching the optical print head from the apparatus body is complicated.

SUMMARY OF THE INVENTION

An image forming apparatus according to the embodiment includes: a photosensitive drum rotatable with respect to an apparatus body; an optical print head that exposes the photosensitive drum to light in response to a drive signal from a controller provided in the apparatus body and is inserted and removed in a rotational axis direction of the photosensitive drum from a front side of the apparatus body by an operator; a front plate located at the front side of the apparatus body and is formed with an opening through which the optical print head to be inserted into and removed from the apparatus body passes; a cable that has one end connected to the optical print head and is wired along the optical print head toward the front side of the apparatus body in a state where the optical print head is mounted to the apparatus body; and a connector that is arranged so as to have at least a part located on an outer side of the apparatus body than the opening and to which another end of the cable is connected to be detachably attachable in order to transmit the drive signal from the controller to the optical print head.

Further features of the present invention will become apparent from the following description of exemplary embodiments with reference to the attached drawings.

DESCRIPTION OF THE EMBODIMENTS (Image Forming Apparatus)

Figure 1:
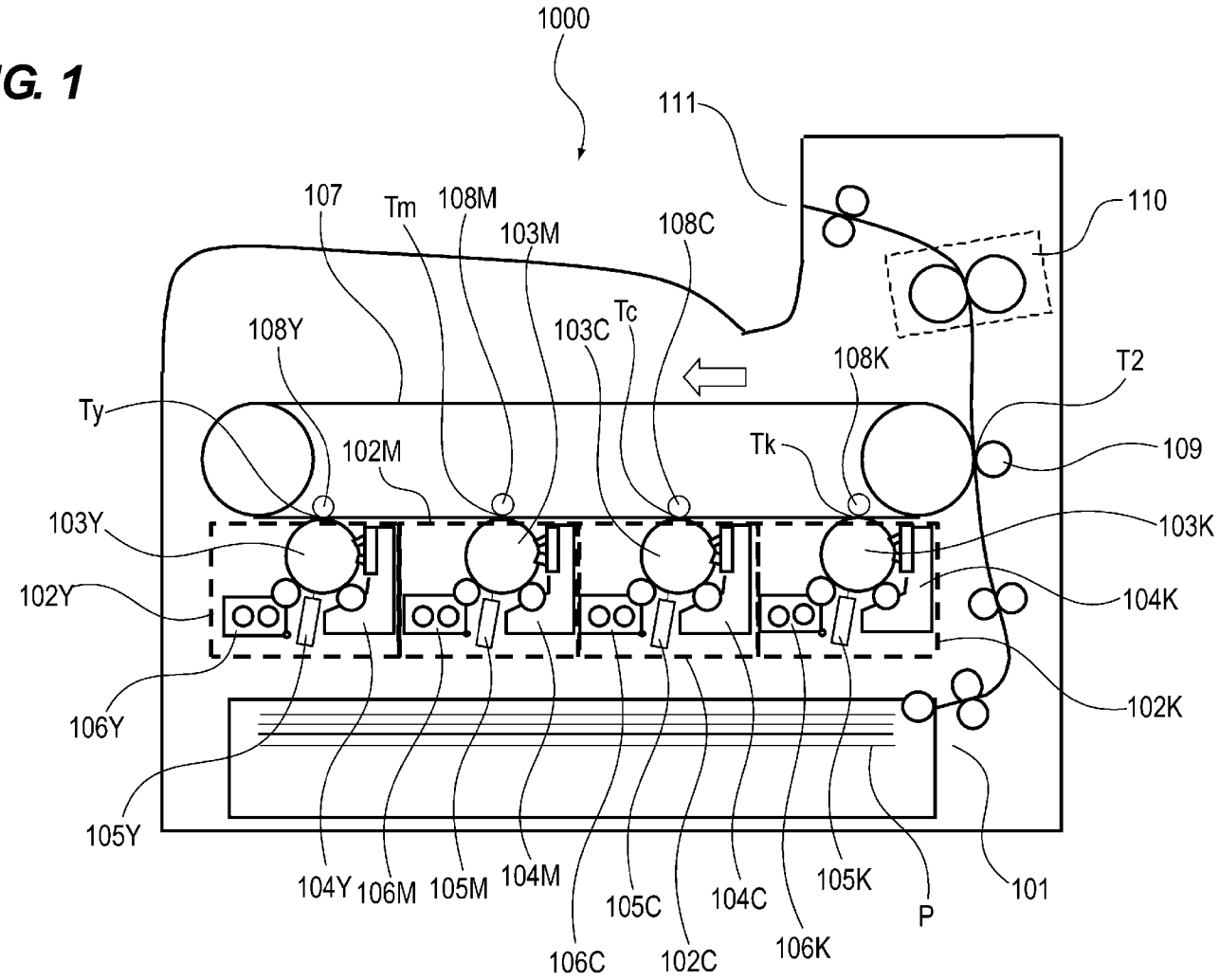
FIG. 1 is a cross-sectional view illustrating a configuration of an image forming apparatus.

First, a schematic configuration of the image forming apparatus 1000 will be described. FIG. 1 is a schematic cross-sectional view of the image forming apparatus 1000. The image forming apparatus 1000 illustrated in FIG. 1 is a color printer (SFP: single function printer) not including a reading device, but an embodiment may be a copying machine including a reading device.

The image forming apparatus 1000 illustrated in FIG. 1 includes four image forming portions 102Y, 102M, 102C, and 102K (hereinafter collectively referred to simply as an "image forming portion 102") that form toner images of the respective colors of yellow, magenta, cyan, and black. The image forming portions 102Y, 102M, 102C, and 102K include photosensitive drums 103Y, 103M, 103C, and 103K (hereinafter collectively referred to simply as a "photosensitive drum 103"), respectively. Chargers 104Y, 104M, 104C, and 104K (hereinafter collectively referred to simply as a "charger 104") that charge the photosensitive drum, optical print heads 105Y, 105M, 105C, and 105K (hereinafter collectively referred to simply as an "optical print head 105") that expose the photosensitive drum to light, and development devices 106Y, 106M, 106C, and 106K (hereinafter collectively referred to simply as a "development device 106") that develops an electrostatic latent image on the photosensitive drum with toner are provided around the respective photosensitive drums. Incidentally, Y, M, C, and K attached to reference signs indicate toner colors (Y: yellow, M: magenta, C: cyan, and K: black).

The image forming apparatus 1000 illustrated in FIG. 1 is an image forming apparatus that adopts a so-called "lower surface exposure system" that exposes the photosensitive drum 103 to light from below. Hereinafter, a description will be given on the premise of the image forming apparatus adopting the lower surface exposure system, but an image forming apparatus adopting an "upper surface exposure system" that exposes the photosensitive drum 103 to light from above may be used as an embodiment.

The image forming apparatus 1000 includes: an intermediate transfer belt 107 to which a toner image formed on the photosensitive drum 103 is transferred; and primary transfer rollers 108 (Y, M, C, and K) which sequentially transfer the toner images formed on the photosensitive drum 103 to the intermediate transfer belt. The image forming apparatus 1000 further includes: a secondary transfer roller 109 which transfers the toner image on the intermediate transfer belt 107 onto a recording sheet P conveyed from a sheet feeding portion 101; and a fixer 110 that fixes the secondarily transferred image on the recording sheet P. The photosensitive drums 103Y, 103M, 103C, and 103K are in contact with the intermediate transfer belt 107 and form primary transfer portions Ty, Tm, Tc, and Tk together with the primary transfer rollers 108Y, 108M, 108C, and 108K.

(Image Forming Process)

An image forming process of the image forming apparatus 1000 will be briefly described. The charger 104Y charges the surface of the photosensitive drum 103Y. The optical print head 105Y exposes the surface of the photosensitive drum 103Y charged by the charger 104Y to light. As a result, an electrostatic latent image is formed on the photosensitive drum 103Y. Next, the development device 106Y develops the electrostatic latent image formed on the photosensitive drum 103Y with a yellow toner. The yellow toner image developed on the surface of the photosensitive drum 103Y is transferred onto the intermediate transfer belt 107 by the primary transfer roller 108Y in the primary transfer portion Ty. Magenta, cyan, and black toner images are also formed in the similar image forming process and are transferred in each of the primary transfer portions so as to be superimposed on each other on the intermediate transfer belt 107.

The toner images of the respective colors transferred onto the intermediate transfer belt 107 are conveyed to a secondary transfer portion T2 by the intermediate transfer belt 107. A transfer bias to transfer the toner image onto the recording sheet P is applied to the secondary transfer roller 109 arranged in the secondary transfer portion T2. The toner image conveyed to the secondary transfer portion T2 is transferred to the recording sheet P conveyed from the sheet feeding portion 101 by the transfer bias of the secondary transfer roller 109. The recording sheet P onto which the toner image has been transferred is conveyed to the fixer 110. The fixer 110 fixes the toner image on the recording sheet P by heat and pressure. The recording sheet P subjected to the fixing process by the fixer 110 is discharged to a sheet discharging portion 111.

(Drum Unit and Developing Unit)

Figure 2A:
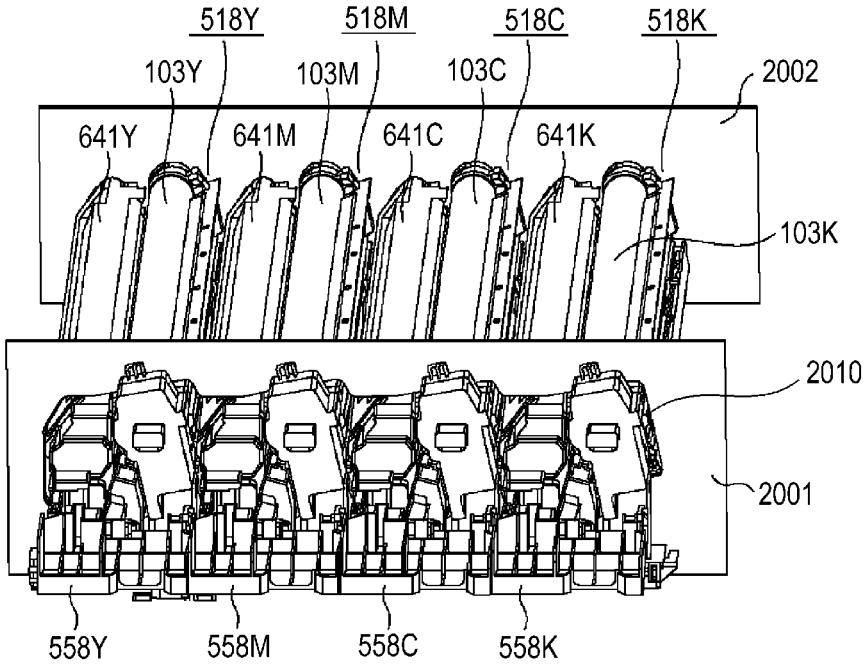
FIGS. 2A and 2B are views illustrating a periphery of a drum unit and a periphery of a developing unit of the image forming apparatus.
Figure 2B:
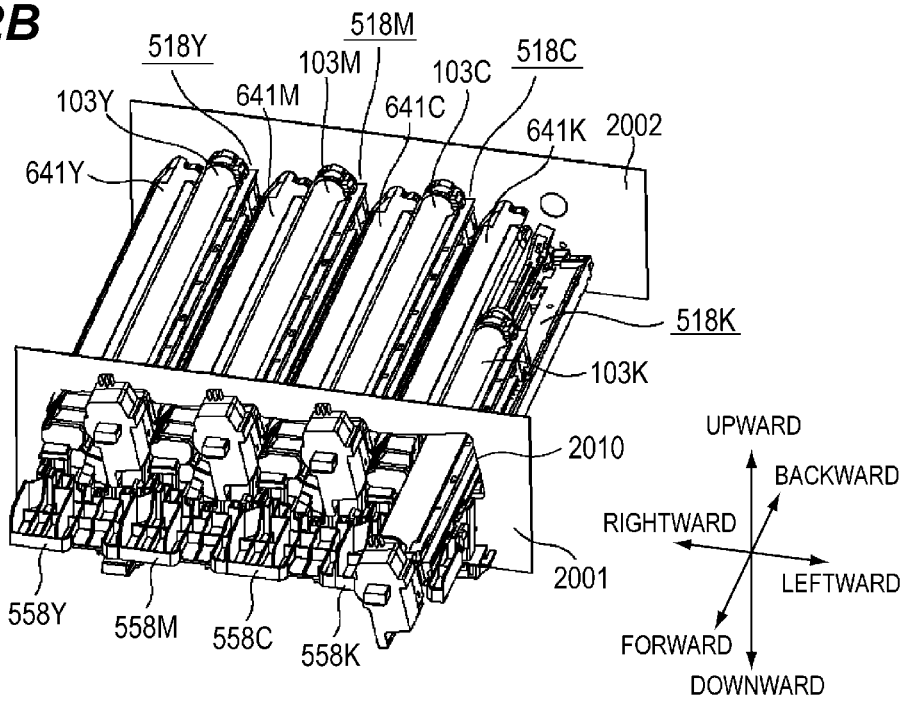

A replaceable drum unit in the image forming apparatus 1000 of the embodiment will be described by way of example. The photosensitive drum 103 and the charger 104 described above may be integrally unitized (as a drum unit or a drum cartridge) together with a cleaning device (not illustrated). An example of such a configuration will be described with reference to FIGS. 2A and 2B. FIG. 2A is a perspective view illustrating a schematic structure of a periphery of a drum unit 518 and a periphery of a developing unit 641 of the image forming apparatus 1000. FIG. 2B is a view illustrating a state where the drum unit 518 is inserted into the image forming apparatus 1000 from the outer side of the apparatus body.

As illustrated in FIGS. 2A and 2B, replaceable drum units 518Y, 518M, 518C, and 518K (hereinafter collectively referred to simply as the "drum unit 518") are attached to the image forming apparatus 1000 of the embodiment. The drum unit 518 is a cartridge replaceable by an operator such as a user and a maintenance person. The drum unit 518 of the embodiment rotatably supports the photosensitive drum 103. More specifically, the photosensitive drum 103 is rotatably supported with respect to a frame body (housing) of the drum unit 518. For example, when service life of the photosensitive drum 103 has expired due to wear by cleaning of the cleaning device, the operator who performs maintenance takes out the drum unit 518 from the apparatus body of the image forming apparatus 1000 through an opening 2010 formed in a front plate 2001 to be described later to replace the photosensitive drum 103. Incidentally, the drum unit 518 may be configured to include the photosensitive drum 103 without including the charger 104 and the cleaning device.

As illustrated in FIGS. 2A and 2B, developing units 641Y, 641M, 641C, and 641K (hereinafter collectively referred to simply as the "developing unit 641"), which are separate bodies from the drum unit 518, are attached to the image forming apparatus 1000 of the embodiment. The developing unit 641 of the embodiment is a cartridge in which the development device 106 illustrated in FIG. 1 and a toner accommodating portion are integrated. The development device 106 includes a developing sleeve which is a developer carrying member which carries a developer. The developing unit 641 is provided with a plurality of gears configured to rotate a screw that stirs the toner and the carrier. When these gears deteriorate over time, the operator removes the developing unit 641 from the apparatus body of the image forming apparatus 1000 to replace the developing unit 641. Incidentally, an embodiment of the drum unit 518 and the developing unit 641 may be a process cartridge in which the drum unit 518 and the developing unit 641 are integrated.

As illustrated in FIG. 2A, the image forming apparatus 1000 includes the front plate 2001 formed using sheet metal and a rear plate 2002 formed similarly using sheet metal. The front plate 2001 is a side wall that forms a part of the housing of the apparatus body of the image forming apparatus 1000 on the front side (front side) of the apparatus body of the image forming apparatus 1000. The rear plate 2002 is a side wall that forms a part of the housing of the apparatus body of the image forming apparatus 1000 on the rear side (back side) of the apparatus body of the image forming apparatus 1000. As illustrated in FIG. 2A, the front plate 2001 and the rear plate 2002 are arranged to oppose each other, and sheet metal (not illustrated) serving as a beam is bridged between the front plate 2001 and the rear plate 2002. Each of the front plate 2001, the rear plate 2002, and the beam (not illustrated) forms a part of the housing (frame body) of the image forming apparatus 1000.

The opening 2010 is formed in the front plate 2001 such that the drum unit 518 and the developing unit 641 can be inserted and removed into and from the apparatus body along a rotational axis direction of the photosensitive drum from the front side of the image forming apparatus 1000. The drum unit 518 and the developing unit 641 are mounted at predetermined positions of the apparatus body of the image forming apparatus 1000 through the opening 2010 (mounting position). In addition, the image forming apparatus 1000 includes covers 558Y, 558M, 558C, and 558K (hereinafter collectively referred to simply as a "cover 558") that cover the front sides of both the drum unit 518 and the developing unit 641 mounted at mounting positions. The cover 558 has one end, fixed to the apparatus body of the image forming apparatus 1000 by a hinge, so as to be rotatable with respect to the apparatus body of the image forming apparatus 1000 by the hinge. The operator opens the cover 558 to take out the drum unit 518 or the developing unit 641 inside the apparatus body, inserts the new drum unit 518 or developing unit 641, and closes the cover 558, whereby the replacement work is completed.

In the following description, a side of the front plate 2001 is defined as the front side (front side) and a side of the rear plate 2002 is defined as the rear side (back side) with respect to the apparatus body as illustrated in FIGS. 2A and 2B. In addition, a side where the photosensitive drum 103Y on which an electrostatic latent image relating to a yellow toner image is to be formed is arranged is defined as the right side using, as a reference, the photosensitive drum 103K on which an electrostatic latent image relating to a black toner image is to be formed. A side where the photosensitive drum 103K on which the electrostatic latent image relating to the black toner image is to be formed is arranged is defined as the left side using, as a reference, the photosensitive drum 103Y on which the electrostatic latent image relating to the yellow toner image is to be formed. Further, a direction perpendicular to the front-rear direction and the left-right direction defined herein, the direction facing upward in a vertical direction is defined as an upward direction, and a direction perpendicular to the front-rear direction and the left-right direction defined herein, the direction facing downward in the vertical direction is defined as a downward direction. The defined forward direction, backward direction, rightward direction, leftward direction, upward direction, and downward direction are illustrated in FIGS. 2A and 2B. In addition, the rotational axis direction of the photosensitive drum 103 described in the following text is a direction substantially coinciding with the front-rear direction illustrated in FIGS. 2A and 2B.

Figure 3A:
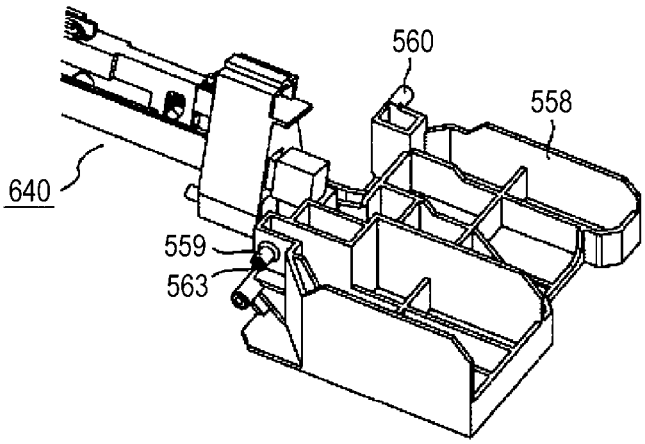
FIGS. 3A to 3D are views illustrating a cover rotatable with respect to the image forming apparatus.

Next, the cover 558 will be described with reference to FIGS. 3A to 3D. FIG. 3A is a perspective view of the cover 558 as viewed from the right side, FIG. 3B is a perspective view of the cover 558 as viewed from the left side, FIG. 3C is a view for describing the front plate 2001 to which the cover 558 has been attached, and FIG. 3D is a view of the front plate 2001 in which the cover 558 is not illustrated.

Figure 3B:
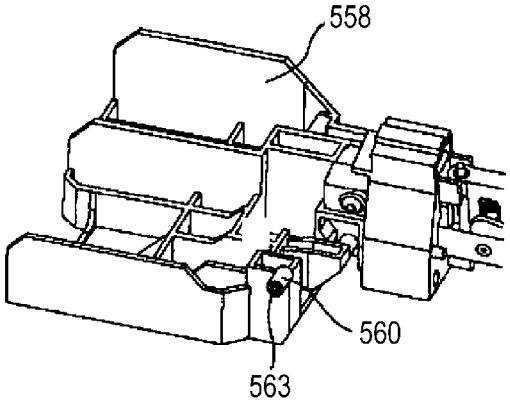
Figure 3C:
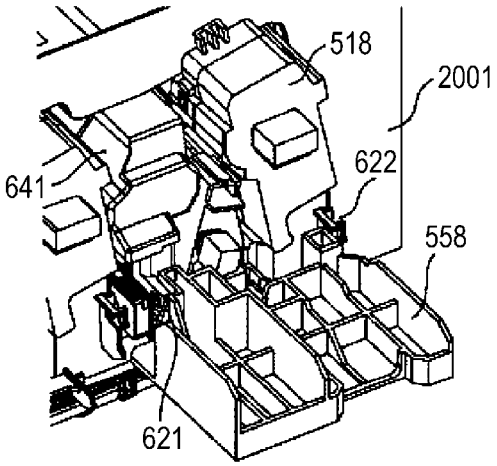

The operator such as a user and a maintenance person can detach the drum unit 518 from the apparatus body by setting the cover 558 in an open state (FIG. 3C). The closed cover 558 is located on an insertion and removal path of the drum unit 518 and the developing unit 641. Thus, it is difficult for the operator to perform the replacement work of the drum unit 518 and the developing unit 641 if the cover 558 is in a closed state. The operator can replace the drum unit 518 by opening the cover 558, and closes the cover 558 after completing the work.

As illustrated in FIGS. 3A and 3B, the cover 558 is provided with rotation shaft portions (559 and 560). The rotation shaft portion 559 is a cylindrical projection that projects to the right side of the cover 558. On the other hand, the rotation shaft portion 560 is a cylindrical projection that projects to the left side of the cover 558. Incidentally, a rotational axis 563 is a rotation center axis of the cover 558 that rotates about the rotation shaft portions (559 and 560).

Figure 3D:
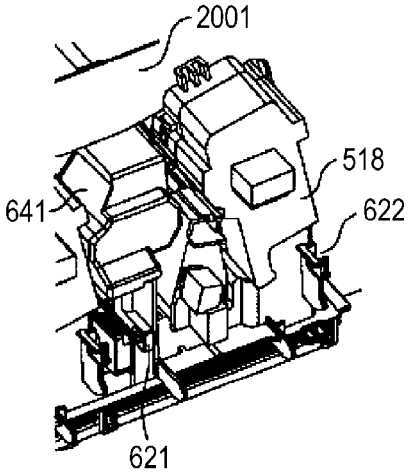

As illustrated in FIGS. 3C and 3D, the front plate 2001 is provided with: a bearing member 621 to which the rotation shaft portion 559 of the cover 558 is fitted; and a bearing member 622 to which the rotation shaft portion 560 is fitted. As illustrated in FIG. 3C, the rotation shaft portion 559 of the cover 558 is rotatably fitted to the bearing member 621 of the front plate 2001, and the rotation shaft portion 560 is rotatably fitted to the bearing member 622 of the front plate 2001.

(Optical Print Head)

Next, the optical print head 105 will be described. Here, there is a laser beam scanning exposure system in which an irradiation beam of a semiconductor laser is scanned with a rotating polygon mirror or the like to expose a photosensitive drum to light through an f-θ lens or the like, as an example of an exposure system adopted in an image forming apparatus of an electrophotographic system. The "optical print head 105" described in the embodiment is used for an LED exposure system, which exposes the photosensitive drum 103 to light using light emitting elements such as LEDs arrayed along the rotational axis direction of the photosensitive drum 103, and is not used for the laser beam scanning exposure method described above.

The optical print head 105 described in the embodiment is provided on the lower side in the vertical direction of the rotational axis of the photosensitive drum 103, and an LED 503 of the optical print head 105 exposes the photosensitive drum 103 to light from below. However, the optical print head 105 may be configured to be provided on the upper side in the vertical direction of the rotational axis of the photosensitive drum 103 such that the photosensitive drum 103 is exposed from above.

Figure 4:
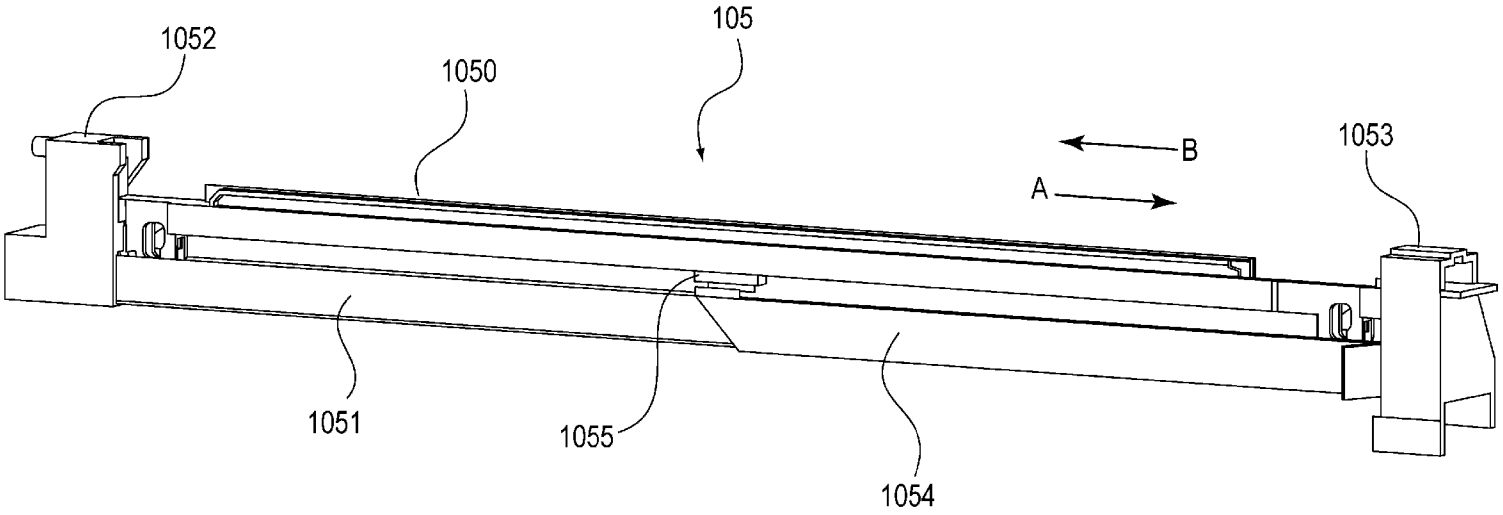
FIG. 4 is a perspective view for describing a configuration of an optical print head.

FIG. 4 is a view for describing a configuration of the optical print head 105. All the four optical print heads 105Y, 105M, 105C, and 105K illustrated in FIG. 1 as the optical print head 105 have the same configuration. As illustrated in FIG. 4, the optical print head 105 includes an exposure portion 1050, a support member 1051, attachment portions 1052 and 1053, and a cable 1054. The exposure portion 1050 and the support member 1051 are sometimes collectively referred to simply as the "optical print head 105". The exposure portion 1050 exposes the photosensitive drum 103 to light. The exposure portion 1050 includes: a long substrate in which a plurality of light emitting elements such as light emitting diodes (LEDs) is arranged one-dimensionally (in a straight line) along a longitudinal direction of the optical print head 105; and a lens that collects light from the light emitting elements.

Figure 5A:
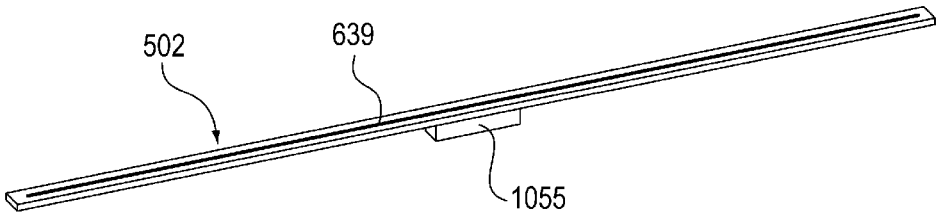
FIGS. 5A to 5C are views illustrating a substrate in an optical print head.
Figure 5B:
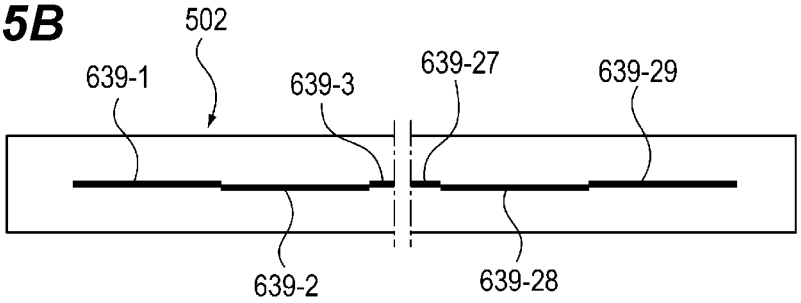
Figure 5C:
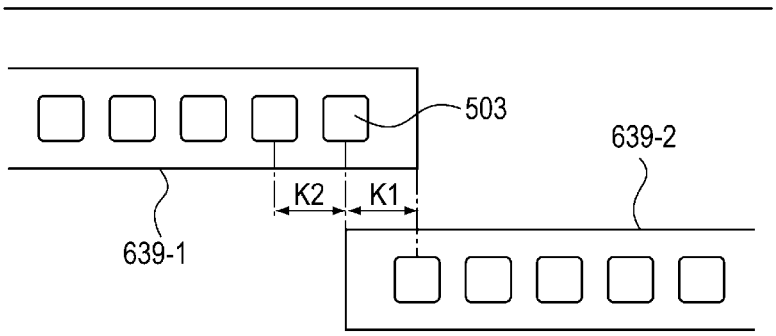

Here, the long substrate on which the plurality of light emitting elements is arranged, and a lens array including a plurality of lenses, which are included in the exposure portion 1050, will be described. First, the substrate of the exposure portion 1050 will be described. FIG. 5A is a schematic perspective view of a substrate 502. FIG. 5B is a view for describing an LED chip 639 mounted on the substrate 502. FIG. 5C is an enlarged view of FIG. 5B, and is the view illustrating a plurality of the LEDs 503 (an example of the light emitting element) provided on the LED chip 639.

As illustrated in FIG. 5A, the LED chip 639 is provided on one surface of the substrate 502, and a long connector 1055 is provided on the other surface (a surface opposite to the side where the light emitting elements are arrayed). The connector 1055 is attached to a lower surface of the substrate 502 such that a longitudinal direction thereof extends along a longitudinal direction of the substrate 502. The substrate 502 is provided with a wiring configured to supply a signal to each of the LED chips 639. As illustrated in FIG. 4, one end of a flexible flat cable (a cable in which a plurality of flat conductors is covered with a film-shaped insulator), which is an example of the cable 1054, is connected to the connector 1055.

The apparatus body of the image forming apparatus 1000 is provided with a connector 2004 (see FIG. 7) to which a cable (not illustrated) extending from a controller (not illustrated) is connected. The other end of the cable 1054 is also connected to the connector 2004. The other end of the cable 1054 is connected to be detachably attachable to the connector 2004. That is, the connector 2004 serves as a relay connector that relays the cable extending from the controller and the cable extending from the connector 1055. Therefore, a drive signal transmitted from the controller to the optical print head 105 is further transmitted from the controller via the cable, the relay connector 2004, and the cable 1054 to the connector 1055 and input to the substrate 502. The LED chip 639 is driven by the control signal input to the substrate 502.

Here, the cable connecting the controller and the connector 2004 may be excluded. That is, the connector 2004 may be directly provided in the controller.

The LED chip 639 mounted on the substrate 502 will be described in more detail. As illustrated in FIGS. 5B and 5C, a plurality of (29) LED chips 639-1 to 639-29 on which the plurality of LEDs 503 is arranged is arrayed on one surface of the substrate 502. On each of the LED chips 639-1 to 639-29, 516 LEDs 503 are arrayed in a row in the longitudinal direction thereof. In the longitudinal direction of the LED chip 639, a distance K2 between centers of the adjacent LEDs 503 corresponds to the resolution of the image forming apparatus. Since the resolution of the image forming apparatus 1000 of the embodiment is 1200 dpi, the LEDs 503 are arrayed in a row such that the distance between the centers of the adjacent LEDs 503 is 21.16 μm in the longitudinal direction of the substrate 502 on the LED chips 639-1 to 639-29. Thus, an exposure range of the optical print head 105 of the embodiment is about 314 mm. A photosensitive layer of the photosensitive drum 103 is formed to have a width of 314 mm or longer. Since a length of a long side of an A4-size recording sheet and a length of a short side of an A3-size recording sheet are 297 mm, the optical print head 105 of the embodiment has an exposure range enabling image formation on the A4-size recording sheet and the A3-size recording sheet.

The LED chips 639-1 to 639-29 are alternately arranged in two rows along the rotational axis direction of the photosensitive drum 103. That is, as illustrated in FIG. 5B, the odd-numbered LED chips 639-1, 639-3, . . . , and 639-29 counted from the left side are mounted in a row in the longitudinal direction of the substrate 502, and the even-numbered LED chips 639-2, 639-4, . . . , and 639-28 are mounted in a row in the longitudinal direction of the substrate 502. Since the LED chips 639 are arranged in this manner, the distance K1 between the centers of the LEDs arranged at one end of one LED chip 639 and the other end of the other LED chip 639 in the different LED chips 639 adjacent to each other can be set to be equal to a distance K2 between centers of adjacent LEDs 503 on the single LED chip 639 in the longitudinal direction of the LED chip 639 as illustrated in FIG. 5C. Although the configuration using the LED 503 as an exposure light source is exemplified in the embodiment, an organic electro luminescence (organic EL) device may be used as the exposure light source.

Figure 5D:
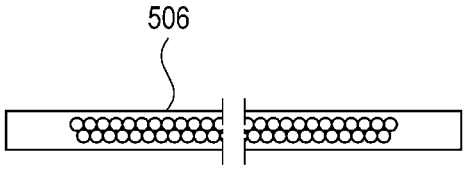
FIGS. 5D and 5E are views illustrating a lens array.
Figure 5E:
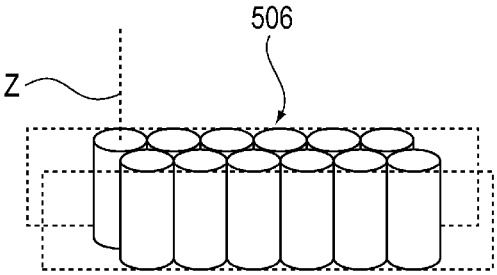

Next, the lens array 506 will be described. FIG. 5D is a schematic view of the lens array 506 as viewed from a side of the photosensitive drum 103. FIG. 5E is a schematic perspective view of the lens array 506. As illustrated in FIGS. 5D and 5E, a plurality of lenses is arrayed in two rows along an array direction of the plurality of LEDs 503. The respective lenses are alternately arranged such that one of lenses in one row is arranged so as to be in contact with both of two lenses adjacent to each other in an array direction of lenses in the other row. Each of the lenses is a rod lens having a cylindrical shape and made of glass. Incidentally, a material of the lens is not limited to glass, but may be plastic. A shape of the lens is not limited to the cylindrical shape, and may be a polygonal prism such as a hexagonal prism.

Radiation light emitted from the LED 503 is incident on the lens of the lens array 506. The lens has a function of collecting the incident radiation light onto the surface of the photosensitive drum 103. The optical print head 105 is assembled such that a distance between a light emitting surface of the LED 503 and a light incident surface of the lens and a distance between a light emitting surface of the lens and the surface of the photosensitive drum 103 become substantially equal.

As illustrated in FIG. 4, the cable 1054 having one end connected to the connector 1055 is wired from the connector 1055 toward one side of the apparatus body along the optical print head 105 (one end side of the optical print head 105 in the rotational axis direction of the photosensitive drum 103).

In addition, the support member 1051 is an elongated member that supports the long substrate on which the light emitting element (LED) is arranged. The support member 1051 is a member that supports the exposure portion 1050 in the longitudinal direction of the exposure portion 1050 and has a concave-shaped cross-sectional shape, and is formed using sheet metal in the embodiment.

(Substrate Configuration to Control Optical Print Head)

Figure 6:
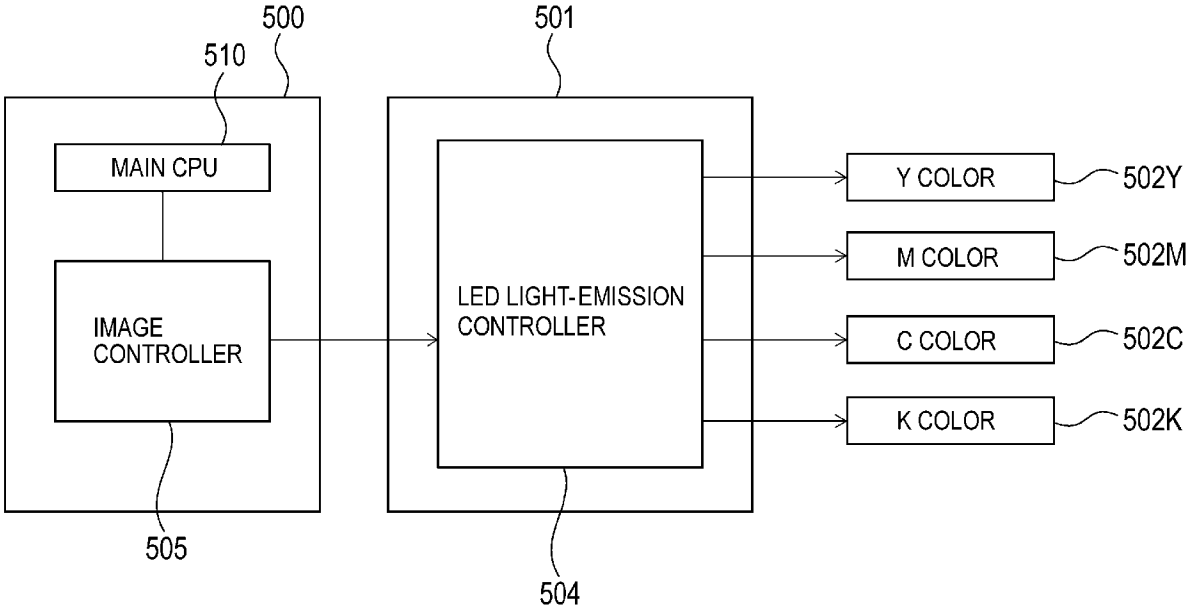
FIG. 6 is a block diagram illustrating a substrate configuration to control the optical print head.

Here, a substrate configuration to control the optical print head 105 will be described with reference to FIG. 6. FIG. 6 illustrates a control block diagram. The substrate configuration to control the optical print head 105 in the embodiment includes a body substrate 500, an LED control board 501, and printed board 502 (Y, M, C, and K) on which a plurality of light emitting elements such as LEDs and a lens array are mounted.

The body substrate 500 is a printed board which controls each portion of the apparatus body during image formation. The body substrate 500 includes a main CPU (controller) 510, and controls each portion of the apparatus body by the main CPU 510. In addition, the body substrate 500 includes an image controller 505 which performs image processing, and outputs image data that needs to be formed to an LED light emission controller 504 when receiving an image formation instruction from the main CPU 510.

The image data includes a plurality of pieces of unit image data corresponding to the plurality of LED elements (light emitting elements) included in the printed board 502 on which the plurality of light emitting elements and the lens array are mounted. The image controller 505 outputs the image data to the LED light emission controller 504 in a predetermined order.

The LED light emission controller 504 generates irradiation data using the image data output from the image controller 505. The image data from the image controller 505 contains color information on which color the image is, and the LED light emission controller 504 transmits irradiation data corresponding to each color to the printed board 502 on which an LED element group of each color has been mounted, based on the color information. The LED element is turned on to irradiate the photosensitive drum with light based on the irradiation data transmitted to the printed board 502.

Here, the LED control board 501 also has a function as a relay substrate configured to electrically connect the body substrate 500 and the printed board 502.

(Attachment Configuration of Optical Print Head with Respect to Image Forming Apparatus)

Figure 7:
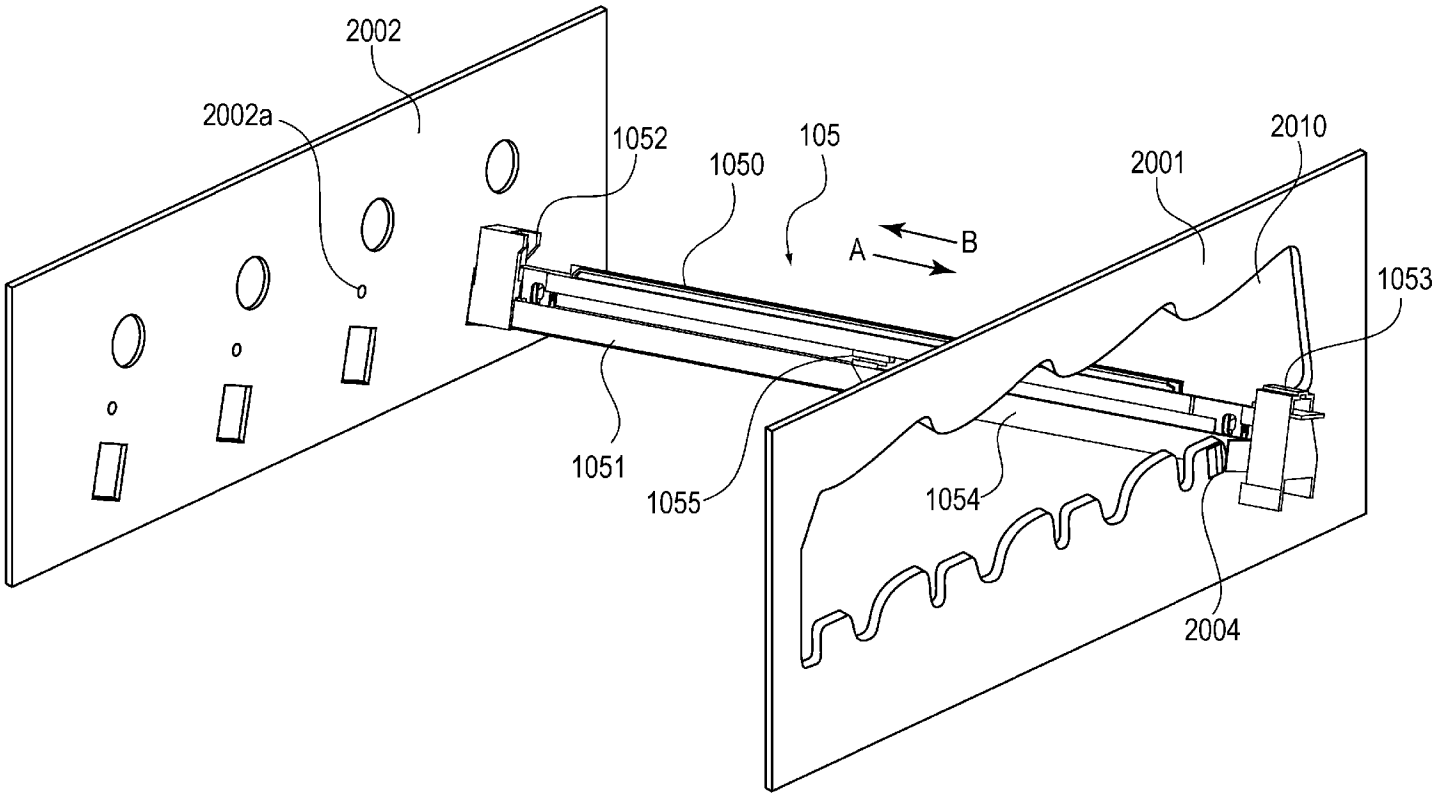
FIG. 7 is a perspective view illustrating a state where the optical print head is accommodated in the image forming apparatus.

FIG. 7 is a perspective view illustrating a state where the optical print head 105 is accommodated in the image forming apparatus 1000. Regarding the housing of the image forming apparatus 1000, only the main parts of the front plate 2001 and the rear plate 2002 as each part of the housing are illustrated.

As illustrated in FIG. 7, the opening 2010 is formed in the front plate 2001 on the front side of the apparatus body of the image forming apparatus 1000. The optical print head 105 is movable to a mounting position where the optical print head 105 has been mounted on the apparatus body so as to expose the photosensitive drum 103 to light and a pull-out position where optical print head 105 has been pulled out from the mounting position toward the front side by the operator. The optical print head 105 located at the mounting position is moved by the operator in the direction of the arrow A in FIG. 7 to move to the pull-out position. On the other hand, the optical print head 105 located at the pull-out position is moved by the operator in the direction of the arrow B in FIG. 7 to move to the mounting position. The operator can attach or detach the optical print head 105 to or from the image forming apparatus 1000 by inserting or removing the optical print head 105 in the rotational axis direction of the photosensitive drum 103 from the back side to the front side of the apparatus body (in the direction of the arrow A) or from the front side to the back side (the direction of the arrow B) through the opening 2010. When it is necessary to replace the optical print head 105 or the maintenance work is required, the operator pulls out the optical print head 105 located at the mounting position to the pull-out position and works.

The front plate 2001 and the rear plate 2002 are the parts of the housing of the image forming apparatus 1000 and support one end side and the other end side of the optical print head 105 located at the mounting position, respectively.

The front plate 2001 supporting one end portion in the longitudinal direction of the optical print head 105 is arranged on the front side of the image forming apparatus 1000. The rear plate 2002 supporting the other end portion in the longitudinal direction of the optical print head 105 is arranged on the back side of the image forming apparatus 1000.

Figure 8A:
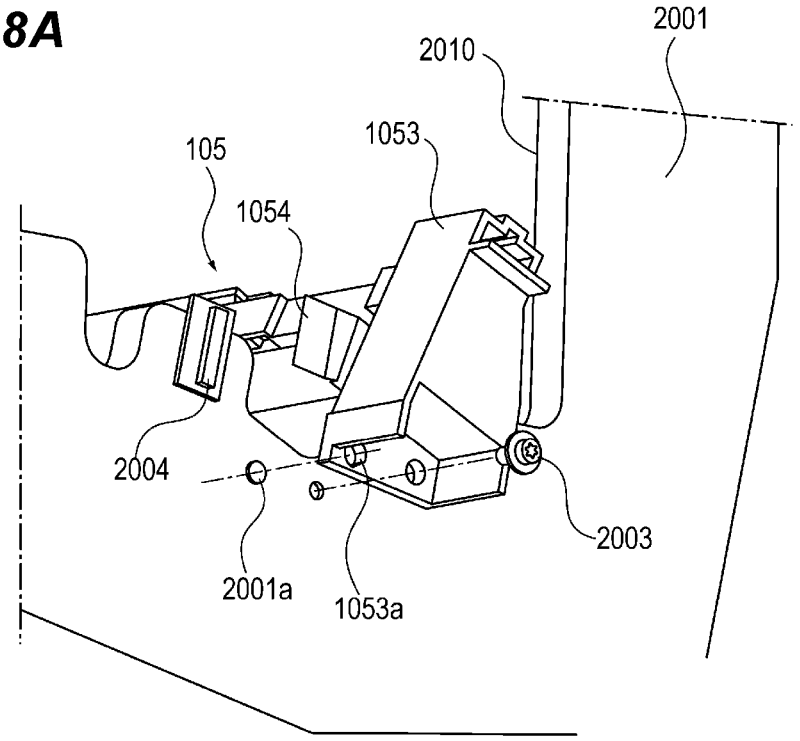
FIGS. 8A and 8B are enlarged perspective views of an attachment portion of the optical print head.
Figure 8B:
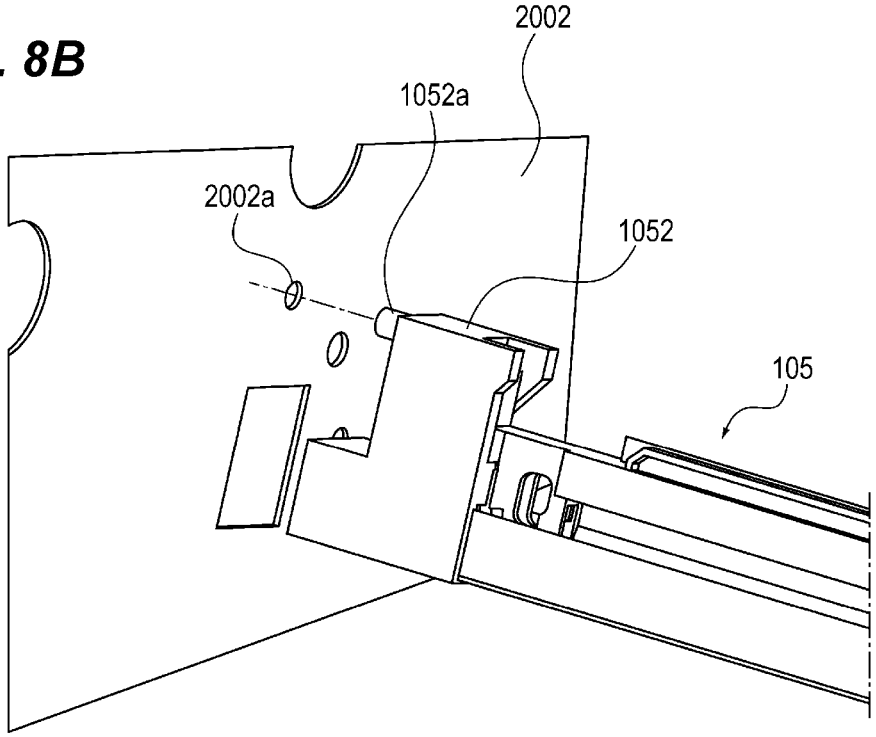

FIG. 8A is an enlarged perspective view of the attachment portion 1053 of the optical print head 105. FIG. 8B is an enlarged perspective view of the attachment portion 1052 of the optical print head 105. As illustrated in FIGS. 8A and 8B, the attachment portions 1052 and 1053 are attachment members configured to attach and fix the optical print head 105 to the front plate 2001 and the rear plate 2002 which form the parts of the housing of the image forming apparatus 1000.

As illustrated in FIG. 8A, the attachment portion 1053 has a hole 1053*a* into which a projection 2001*a* provided on the front plate 2001 is inserted. As the projection 2001*a* provided on the front plate 2001 is inserted into the hole 1053*a* of the attachment portion 1053, the position of the optical print head 105 is determined with respect to the image forming apparatus 1000.

As illustrated in FIG. 8B, the attachment portion 1052 has a projection 1052*a* (an example of a positioning boss) to be inserted into a hole 2002*a* (an example of a positioning hole) provided in the rear plate 2002. As the projection 1052*a* of the attachment portion 1052 is inserted into the hole 2002*a* of the rear plate 2002, the optical print head 105 is accommodated inside the image forming apparatus 1000.

After being positioned with respect to the image forming apparatus 1000, the optical print head 105 is fastened to the front plate 2001 by a small screw 2003 and fixed with respect to the image forming apparatus 1000 as illustrated in FIG. 8A. When fastening the optical print head 105 to the front plate 2001, a fastening unit thereof is not limited to the small screw 2003. Instead of the small screw 2003, for example, a screw may be used. However, the small screw or the screw, which can be easily attached and detached with a screwdriver or the like, is ideal when considering that it is desirable that fastening of the optical print head 105 with respect to the front plate 2001 be easily releasable by the operator. Incidentally, the optical print head 105 is fastened to the front plate 2001 only at one point using the small screw 2003 in FIG. 8A, but may be fastened at a plurality of points.

After the optical print head 105 is attached inside the image forming apparatus 1000, the cable 1054 is connected to be detachably attachable to the connector 2004 provided in the front plate 2001 of the image forming apparatus 1000.

The connector 2004 is fixed to the apparatus body such that at least a part of the connector 2004 is located on the front side of the opening 2010. That is, the connector 2004 is provided on the front side of the image forming apparatus 1000, and at least a part of the connector 2004 is located on the outer side of the apparatus body beyond the opening 2010. Here, the front side of the image forming apparatus 1000 is a downstream side in a direction of taking out the optical print head 105 from the image forming apparatus 1000. On the other hand, the back side of the image forming apparatus 1000 is an upstream side in the direction of taking out the optical print head 105 from the image forming apparatus 1000. As illustrated in FIG. 8A, the connector 2004 provided in the image forming apparatus 1000 is fixed to the front plate 2001 that supports one end side of the optical print head 105 in the rotational axis direction of the photosensitive drum 103 as described above. The connector 2004 is fixed to a surface on the front side of the front plate 2001 (the side opposite to the side where the rear plate 2002 is arranged with respect to the front plate 2001) in consideration of the workability of the operator.

Although the configuration in which the connector 2004 is fixed to the surface on the front side of the front plate 2001 is exemplified as the configuration in which the connector 2004 is provided on the front plate 2001 in the embodiment, the invention is not limited thereto. The connector 2004 may be fixed to a surface on the back side of the front plate 2001 (the side where the rear plate 2002 is arranged with respect to the front plate 2001). In addition, the connector 2004 may be provided on the front side of the optical print head 105. In this case, at least a part of the connector 2004 is located on the front side of the opening 2010 in the state where the optical print head 105 is mounted to the apparatus body. In other words, a part of the connector 2004 is exposed to the outer side of the apparatus body beyond the opening 2010.

(Description on Cable)

Next, the wiring of the cable 1054 with respect to the optical print head 105 will be described with reference to FIG. 9.

Figure 9:
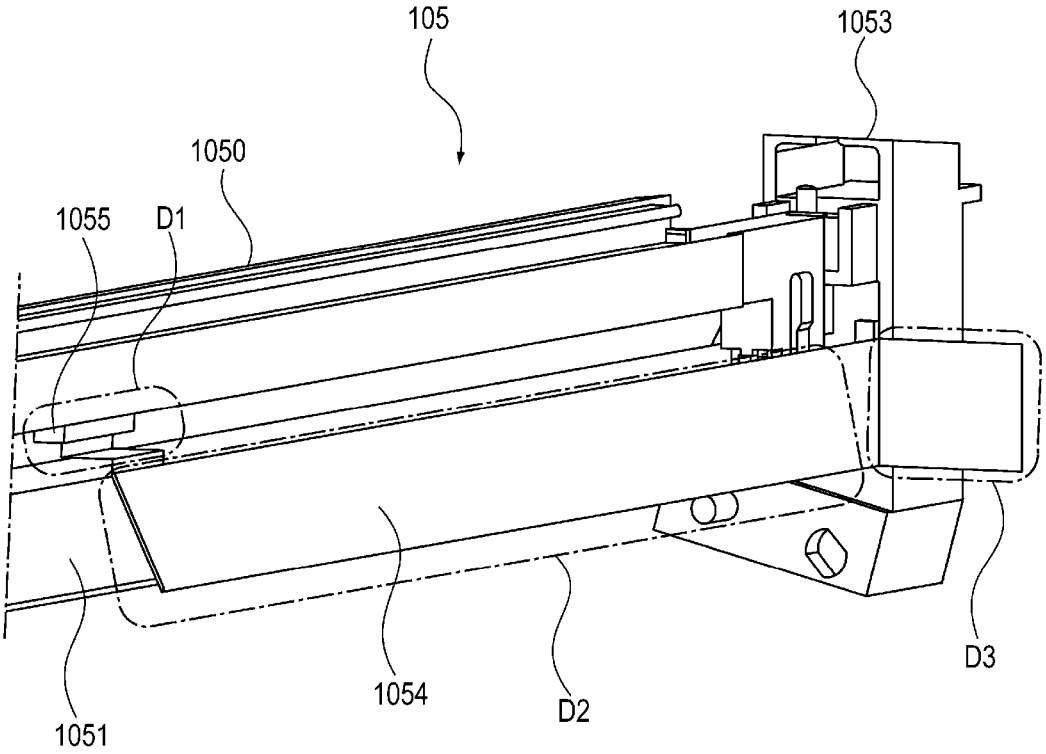
FIG. 9 is a view illustrating wiring of a cable with respect to the optical print head.

In an area D1 illustrated in FIG. 9, the cable 1054 extended downward from the connector 1055 is folded horizontally and folded downward again so as to follow the support member 1051.

In an area D2 illustrated in FIG. 9, the cable 1054 is folded in the direction of taking out the optical print head 105 (diagonally to the right in FIG. 9) from the state of following the support member 1051, thereby being extended to the front side of the image forming apparatus 1000 in the longitudinal direction of the optical print head 105. At this time, the cable 1054 is fixed to a side surface of the support member 1051 by an adhesive member such as a double-sided tape. This prevents the cable 1054 from being broken apart from the support member 1051. In addition, the cable 1054 can be wired along the optical print head 105 from the connector 1055 toward the one end side of the optical print head 105 in the rotational axis direction of the photosensitive drum 103.

In an area D3 illustrated in FIG. 9, the cable 1054 extended from a center portion in the longitudinal direction of the optical print head 105 to the front side of the image forming apparatus 1000 is bent on the front side of the attachment portion 1053 in the horizontal direction of the image forming apparatus 1000. Although the cable 1054 is bent in the horizontal direction regarding the area D3 in the embodiment, the bending is not indispensable. It is sufficient if the cable 1054 is not fixedly positioned with respect to the optical print head 105 such that the end portion thereof can be connected to the connector 2004 provided in the front plate 2001.

(Description Regarding Work of Attaching Optical Print Head to Image Forming Apparatus)

Next, the work of attaching the optical print head 105 of the embodiment to the image forming apparatus 1000 will be described. Table 1 shows a procedure to attach the optical print head 105 of the embodiment to the image forming apparatus 1000. In the embodiment, the attachment can be performed by the following two actions as shown in Table 1.

TABLE 1

| ACTION | STANDING POSITION OF OPERATOR | WORK CONTENT |
|---|---|---|
| 1 | FRONT | OPTICAL PRINT HEAD IS MOUNTED FROM FRONT SIDE OF IMAGE FORMING APPARATUS |
| 2 | FRONT | CABLE IS ATTACHED TO CONNECTOR OF OPTICAL PRINT HEAD |

An operator stands on the front side of the image forming apparatus 1000 (on the front plate 2001 side) and opens the cover 558 (see FIGS. 3A to 3D) on the front side of the image forming apparatus 1000 to form a state where the opening to insert the optical print head 105 is visually confirmed. In this state, the optical print head 105 is inserted from the opening 2010 on the front side of the image forming apparatus 1000 and mounted to the apparatus body (Action 1). At this time, the cable 1054 is connected to the optical print head 105 on one end thereof and is wired along the optical print head 105 toward the front side of the apparatus body. Therefore, one end of the cable 1054 is connected to the optical print head 105 (the connector 1055) on the back side of the front plate 2001 in the state where the optical print head 105 is mounted to the apparatus body to expose the photosensitive drum 103 to light. In addition, the cable 1054 extended to the front side of the image forming apparatus 1000 along the longitudinal direction of the optical print head 105 has the other end side (a portion corresponding to an area D of the cable 1054 illustrated in FIG. 9) passing through an opening 2010 formed in the front plate 2001 as illustrated in FIG. 8A. Next, the other end of the cable 1054 is connected to the connector 2004 provided in the front plate 2001 (Action 2), and the small screw 2003 is attached to the attachment portion 1053. In this manner, the optical print head 105 can be attached to the image forming apparatus 1000 with the two actions.

A configuration in which a cable 1054 is wired on the back side of an image forming apparatus 1000 similarly to the conventional example is illustrated as a comparative example. In this comparative example, the work of attaching an optical print head 105 to the image forming apparatus 1000 will be described. Table 2 shows a procedure to attach the optical print head 105 of the comparative example to the image forming apparatus 1000. In the comparative example, the following three actions are required as shown in Table 2. Here, a case where a standing position of an operator at the time of attaching the cable 1054 to a connector 1055 is set to a side surface side of the image forming apparatus 1000 will be exemplified.

TABLE 2

| ACTION | STANDING POSITION OF OPERATOR | WORK CONTENT |
|---|---|---|
| 1 | FRONT | OPTICAL PRINT HEAD IS INSERTED FROM FRONT SIDE OF IMAGE FORMING APPARATUS |
| 2 | SIDE SURFACE | CABLE IS ATTACHED TO CONNECTOR OF OPTICAL PRINT HEAD |
| 3 | FRONT | OPTICAL PRINT HEAD IS MOUNTED FROM FRONT SIDE OF IMAGE FORMING APPARATUS |

First, the optical print head 105 is inserted through the opening on the front side of the image forming apparatus 1000 (Action 1). Here, the optical print head 105 is in the state of being not yet engaged with the rear plate 2002, but a part of the optical print head 105 exists inside the image forming apparatus 1000.

Next, the inside of the image forming apparatus 1000 is accessed from the side surface side of the image forming apparatus 1000, and the cable 1054 is attached from the optical print head 105 (Action 2). Although the operator can stand on the front side of the image forming apparatus 1000 and attach the cable 1054 from the optical print head 105, it is necessary for the operator to put his or her arm inside the apparatus body from the opening of the front plate to perform the work so that the work becomes troublesome.

Then, the operator again stands on the front side of the image forming apparatus 1000 and inserts the optical print head 105 through the opening on the front side of the image forming apparatus 1000 to be mounted to the apparatus body (Action 3).

As described above, the work requires to move back and forth between the front side and the side surface side of the image forming apparatus 1000 so that the work becomes troublesome in the comparative example. In the embodiment, however, the work of attaching the optical print head 105 is entirely performed on the front side of the image forming apparatus 1000. Even when the operator tries to stand on the front side of the image forming apparatus 1000 to attach the cable 1054 to the connector 1055 in Action 2, the operator needs to perform the work of detaching the cable 1054 from the connector 1055 inside the apparatus body so that the work becomes troublesome. In the embodiment, however, the operator can attach the other end of the cable 1054 to the connector 2004 on the front side of the opening 2010. In addition, the work of attaching the cable 1054 to the connector 1055 can also be performed in a state where the optical print head 105 is detached from the apparatus body.

(Description Regarding Work of Detaching Optical Print Head from Image Forming Apparatus)

Figure 10:
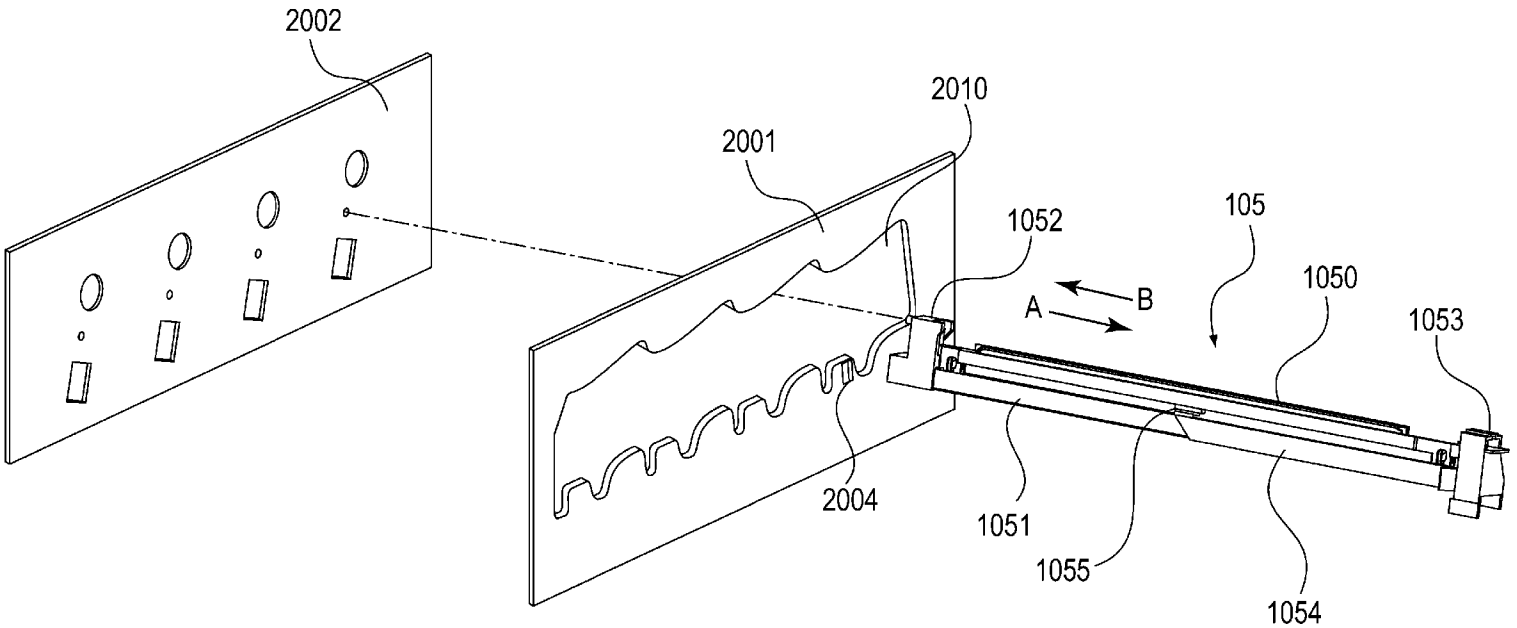
FIG. 10 is a perspective view illustrating a state where the optical print head is taken out from the image forming apparatus.

FIG. 10 is a view illustrating a state where the optical print head 105 is detached from the image forming apparatus 1000. Hereinafter, the work of detaching the optical print head 105 of the embodiment from the image forming apparatus 1000 will be described with reference to FIG. 10. Table 3 shows a procedure to detach the optical print head 105 of the embodiment from the image forming apparatus 1000. In the embodiment, the detachment can be performed with the following two actions as shown in Table 3.

TABLE 3

| ACTION | STANDING POSITION OF OPERATOR | WORK CONTENT |
|---|---|---|
| 1 | FRONT | CABLE IS REMOVED FROM CONNECTOR OF OPTICAL PRINT HEAD |
| 2 | FRONT | OPTICAL PRINT HEAD IS PULLED OUT TO FRONT SIDE OF IMAGE FORMING APPARATUS |

An operator stands on the front side of the image forming apparatus 1000 (on the front plate 2001 side) and opens the cover 558 (see FIGS. 3A to 3D) on the front side of the image forming apparatus 1000 to form a state where the opening to insert the optical print head 105 is visually confirmed. In this state, the cable 1054 is removed from the connector 2004 provided in the front plate 2001 (Action 1). Next, the small screw 2003 is removed from the attachment portion 1053, and the optical print head 105 is pulled out to the front side of the image forming apparatus 1000 (Action 2). As illustrated in FIG. 10, the optical print head 105 is removed to the outer side of the apparatus body of the image forming apparatus 1000 through the opening 2010 of the front plate 2001 and is replaced by the operator.

A configuration in which a cable 1054 is wired on the back side of an image forming apparatus 1000 similarly to the conventional example will be illustrated as a comparative example, and work of detaching an optical print head 105 from the image forming apparatus 1000 in this comparative example will be described. Table 4 shows a procedure to detach the optical print head 105 of the comparative example from the image forming apparatus 1000. In the comparative example, the following three actions are required as shown in Table 4. Here, a case where a standing position of an operator at the time of detaching the cable 1054 from a connector 1055 is set to a side surface side of the image forming apparatus 1000 will be exemplified.

TABLE 4

| ACTION | STANDING POSITION OF OPERATOR | WORK CONTENT |
|---|---|---|
| 1 | FRONT | OPTICAL PRINT HEAD IS PULLED OUT TO FRONT SIDE OF IMAGE FORMING APPARATUS |
| 2 | SIDE SURFACE | CABLE IS REMOVED FROM CONNECTOR OF OPTICAL PRINT HEAD |
| 3 | FRONT | OPTICAL PRINT HEAD IS PULLED OUT TO FRONT SIDE OF IMAGE FORMING APPARATUS |

First, the optical print head 105 is pulled out from the front side of the image forming apparatus 1000 (Action 1). Here, the optical print head 105 is removed from the rear plate 2002, but a part of the optical print head 105 exists inside the image forming apparatus 1000.

Next, the inside of the image forming apparatus 1000 is accessed from the side surface side of the image forming apparatus 1000, and the cable 1054 is detached from the optical print head 105 (Action 2). Although the operator can stand on the front side of the image forming apparatus 1000 and detach the cable 1054 from the optical print head 105, it is necessary for the operator to put his or her arm inside the apparatus body from the opening of the front plate to perform the work so that the work becomes troublesome.

Then, the operator again stands on the front side of the image forming apparatus 1000 and pulls out the optical print head 105 through the opening 2010 on the front side of the apparatus body (Action 3).

As described above, the work requires to move back and forth between the front side and the side surface side of the image forming apparatus 1000 so that the work becomes troublesome in the comparative example. In the embodiment, however, the work of pulling out the optical print head 105 is entirely performed on the front side of the image forming apparatus 1000.

Even when the operator tries to stand on the front side of the image forming apparatus 1000 to detach the cable 1054 from the connector 1055 in Action 2, the operator needs to perform the work of detaching the cable 1054 from the connector 1055 inside the apparatus body so that the work becomes troublesome. In the embodiment, however, the operator can detach the other end of the cable 1054 from the connector 2004 on the front side of the opening 2010 and detach the optical print head 105 from the apparatus body. After detaching the optical print head 105 from the apparatus body as described above, the operator detaches the cable 1054 from the connector 1055.

Accordingly, when adopting the configuration of the embodiment, it is understood that the workability is significantly improved as compared with the case of adopting the configuration of the comparative example. That is, according to the embodiment, it is possible to make the attachment and detachment work of the cable 1054 and insertion and removal work of the optical print head 105 performed from only one direction (the front side of the image forming apparatus 1000) and to easily perform the work of detaching the optical print head 105 from the image forming apparatus 1000.

Since the work is performed from two directions of the front side and the side surface side of the image forming apparatus 1000 in the comparative example, the optical print head 105 is pulled out in a state where the cable 1054 is attached to the optical print head 105 so that there is a risk that a work mistake such as disconnection of the cable 1054 may occur. Thus, it is necessary to additionally provide a unit that prevents the occurrence of the work mistake, and there is a risk of introducing an increase in the number of parts or making the apparatus complicated and large.

In the embodiment, however, the work mistake as in the comparative example hardly occurs since the work is performed from one direction on the front side of the image forming apparatus 1000. Accordingly, it is possible to maintain a small size, which is a feature of the optical print head 105, without increasing the number of parts and making the apparatus complicated and large.

Although the four image forming portions and four optical print heads 105 are used in the above-described embodiment, this number of parts to be used is not limited, and may be appropriately set as necessary.

Although the printer is exemplified as the image forming apparatus 1000 in the above-described embodiment, another image forming apparatus 1000 such as a copying machine and a facsimile machine, or the other image forming apparatus 1000 such as a multi-function printer in which these functions are combined may be used.

Although the configuration in which the connector 2004 to which the other end of the cable 1054 is connected is provided on the front plate which is the part of the housing of the apparatus body is exemplified in the above-described embodiment, the invention is not limited thereto. A point to which the connector 2004 is fixed may be appropriately set as necessary as long as the connector 2004 is on one side of the apparatus body to which the optical print head 105 is inserted and removed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-091892, filed May 11, 2018, which is hereby incorporated by reference herein in its entirety.

What is claimed is:

1. An image forming apparatus comprising:

a photosensitive drum rotatable with respect to an apparatus body;

an optical print head that exposes the photosensitive drum to light in response to a drive signal from a controller provided in the apparatus body and is inserted and removed in a rotational axis direction of the photosensitive drum from a front side of the apparatus body by an operator;

a front plate located at the front side of the apparatus body and that is formed with an opening through which the optical print head to be inserted into and removed from the apparatus body passes;

a cable that has one end connected to the optical print head and is wired along the optical print head toward the front side of the apparatus body in a state in which the optical print head is mounted to the apparatus body; and a connector that is arranged so as to have at least a part located on an outer side of the apparatus body beyond the opening and to which another end of the cable is connected to be detachably attachable in order to transmit the drive signal from the controller to the optical print head.

2. The image forming apparatus according to claim 1, wherein the cable is a flexible flat cable.

3. The image forming apparatus according to claim 1, wherein the connector is fixed to the front plate.

4. The image forming apparatus according to claim 3, wherein the connector is located on the outer side of the apparatus body beyond the front plate.

5. The image forming apparatus according to claim 3, wherein in the connector, a side connected to the cable faces the outer side of the apparatus body.

6. The image forming apparatus according to claim 3, wherein the connector is located on a back side of the front plate.

7. The image forming apparatus according to claim 1, wherein the optical print head and the front plate are fastened by a screw and the optical print head is fixed to the front plate in the state in which the optical print head is mounted to the apparatus body.

8. The image forming apparatus according to claim 1, further comprising a rear plate that forms a part of the housing of the apparatus body on a back side of the apparatus body, wherein the front plate supports one end side of the optical print head in a longitudinal direction of the optical print head in the state in which the optical print head is mounted to the apparatus body, and the rear plate supports another end side of the optical print head in the longitudinal direction in the state in which the optical print head is mounted to the apparatus body.

9. The image forming apparatus according to claim 8, wherein the rear plate is formed with a positioning hole to which a positioning boss formed on the other end side of the optical print head in the longitudinal direction is fitted, and the other end side of the optical print head in the longitudinal direction is positioned with respect to the rear plate and is supported by the rear plate as the positioning boss is fitted to the positioning hole.

10. The image forming apparatus according to claim 1, wherein one end of the cable is connected to the optical print head on a back side of the apparatus body of the front plate in the state in which the optical print head is mounted to the apparatus body.

* * * * *